United States Patent [19]

Haller

[11] Patent Number: 4,572,280

[45] Date of Patent: Feb. 25, 1986

[54] PROCESS FOR COOLING A CONTINUOUSLY CAST INGOT DURING CASTING

[75] Inventor: Walter Haller, Sierre, Switzerland

[73] Assignee: Swiss Aluminium Ltd., Chippis, Switzerland

[21] Appl. No.: 608,487

[22] Filed: May 9, 1984

Related U.S. Application Data

[63] Continuation of Ser. No. 359,895, Mar. 19, 1982, abandoned.

[30] Foreign Application Priority Data

Apr. 2, 1981 [CH] Switzerland ..... 2245/81

[51] Int. Cl.[4] ..... B22D 11/00

[52] U.S. Cl. ..... 164/467; 164/444; 164/487; 164/503

[58] Field of Search ..... 164/444, 467, 487, 503, 164/147.1, 498

[56] References Cited

U.S. PATENT DOCUMENTS

| | | | |
|---|---|---|---|
| 3,616,844 | 11/1971 | Bick et al. | 164/444 |
| 3,741,280 | 6/1973 | Kozheurov et al. | 164/503 |
| 3,753,459 | 8/1973 | Burkhardt et al. | 164/444 |
| 3,757,849 | 9/1973 | Toperzer et al. | 164/444 |
| 3,934,641 | 1/1976 | Chielans | 164/444 |
| 4,236,570 | 12/1980 | Gaule et al. | 164/467 |
| 4,307,772 | 12/1981 | Haller | 164/467 |
| 4,351,384 | 9/1982 | Goodrich | 164/467 |

FOREIGN PATENT DOCUMENTS

| | | | |
|---|---|---|---|
| 2618933 | 11/1976 | Fed. Rep. of Germany | 164/444 |
| 1467702 | 3/1967 | France | 164/444 |

*Primary Examiner*—Nicholas P. Godici
*Assistant Examiner*—Richard K. Seidel
*Attorney, Agent, or Firm*—Bachman & LaPointe

[57] ABSTRACT

The cooling of a continuously cast ingot as it emerges from the mold, during casting, is carried out by applying coolant directly to the ingot around its circumference. In order to reduce the extent of doming, which occurs to the ingot base when cooling is too strong, the coolant is applied, at least at the start of the drop, to zones via streams of coolant. The process can be realized in practice particularly simply with an electromagnetic continuous casting mold which has a cooling device featuring a nozzle, with a ring shaped opening for liquid coolant, directed at the surface of the ingot. A deflecting sheet with turret shaped tongues separated by openings is provided projecting into the path of the coolant emerging from the ring shaped gap. The deflecting sheet is positioned parallel to the main ingot axis and can be moved parallel to that axis.

21 Claims, 5 Drawing Figures

PROCESS FOR COOLING A CONTINUOUSLY CAST INGOT DURING CASTING

This is a continuation of application Ser. No. 359,895 filed Mar. 19, 1982, now abandoned.

BACKGROUND OF THE INVENTION

The invention relates to a process for cooling a continuously cast ingot as it emerges from the mold during casting, and this by jetting coolant directly onto the peripheral part of the ingot.

When casting with direct cooling of the ingot, heat is extracted from the ingot as it emerges from the mold by jetting a coolant onto the ingot just below the mold. At the start of casting the coolant comes into contact only with the dummy base. The resultant indirect extraction of heat leads to a milder solidification of the liquid metal and to a flat ingot base. As the drop continues, the coolant strikes the ingot surface directly, which causes a sudden increase in the rate of heat extraction from the ingot. The stresses due to this thermal shock are greater than the yield strength of the ingot and lead to permanent deformation in the form of a convex doming of the ingot base and, on exceeding the tensile strength of the material, cause cracks in the ingot. To obtain an ingot with a flat base, therefore, the ingot must not be cooled too strongly at the start of the drop.

A process for reducing the cooling intensity at the start of casting is known whereby the coolant is pulsed as it is jetted.

Another process which is known makes use of gas dissolved in the coolant; when the coolant strikes the surface of the ingot, the gas forms an insulating film which reduces the rate of heat extraction.

These processes, however, also have disadvantages. The pulsating coolant produces vibrations which can have a deleterious effect on the structure forming in the ingot as it solidifies. Using coolant with gas dissolved in it on the other hand makes a complicated control facility necessary.

It is therefore an object of the invention to control the cooling in such a way that an essentially flat base is obtained. Also easy manipulation should be assured.

SUMMARY OF THE INVENTION

This object is achieved by way of the invention in that the coolant, at least during the start of casting, is jetted in the form of streams onto zones which are spaced apart.

If this geometrical arrangement of jetting the coolant onto the surface of the ingot is maintained at least over the first 100 mm of the ingot, a practically curve-free base is obtained as a result of the reduced cooling. After the ingot emerging from the mold has reached a length of about 10 cm and the base has become stronger throughout, the cooling can then proceed as normal, i.e. without dividing the coolant into separate streams, as there is then no longer a danger of the ingot end curving. In certain cases it can prove useful to maintain throughout the whole of the drop the geometry of coolant jetting according to the invention.

The width of the jetted coolant streams is preferably such that its ratio to the distance between neighboring streams is between 1:10 and 1:1,5, in particular 1:6 to 1:2, and the distance to the neighboring zone is 5 to 50 mm.

The process according to the invention can be realized with all kinds of continuous casting molds. However from the technical standpoint it is particularly advantageous to employ a mold for electromagnetic casting which features a cooling facility with a nozzle which is directed at the surface of the ingot and has a nozzle opening in the form of a ring shaped slit for jetting a liquid coolant. According to the invention a deflecting surface with at least one opening in it is provided parallel to the main axis of the ingot, projecting into the flow path of the coolant emerging from the ring shaped gap and such that that means of deflecting the coolant stream can be moved parallel to the main axis of the ingot.

The deflection means is, according to a preferred feature of the invention, provided with turret shaped tongues separated by slits or openings.

According to another feature of the invention the ratio of the width of the openings to the distance between neighboring openings is between 1:10 and 1:15, in particular between 1:6 and 1:2 and the distance between neighboring openings 5 to 50 mm.

The tongues can, additionally, feature between the above mentioned slits other slits or openings which are parallel to but shorter in length than the first mentioned slits. This arrangement makes it possible to increase the intensity of cooling, after the start up phase, i.e. via an intermediate stage.

For casting ingots with a round cross section the deflecting surface can be made such that it can be rotated about the main axis of the ingot.

The process according to the invention can be carried out also with an electromagnetic continuous casting mold of the above described kind in which, according to the invention, tube like gas supply nozzles are provided parallel to the ingot axis and such that the outlet ends of the nozzles are situated above the path of the stream of coolant emerging from the ring-shaped gap. The deflection of the coolant in this case is effected by the stream of gas emerging from the nozzles.

The spacing of neighboring nozzles is preferably 5–50 mm, in particular 15–25 mm. The nozzles can be connected up to a gas supply ring.

BRIEF DESCRIPTION OF THE DRAWINGS

Further advantages, features and details of the invention are revealed in the following description of exemplified embodiments and with the help of the drawings viz.

DETAILED DESCRIPTION

Figure 1:
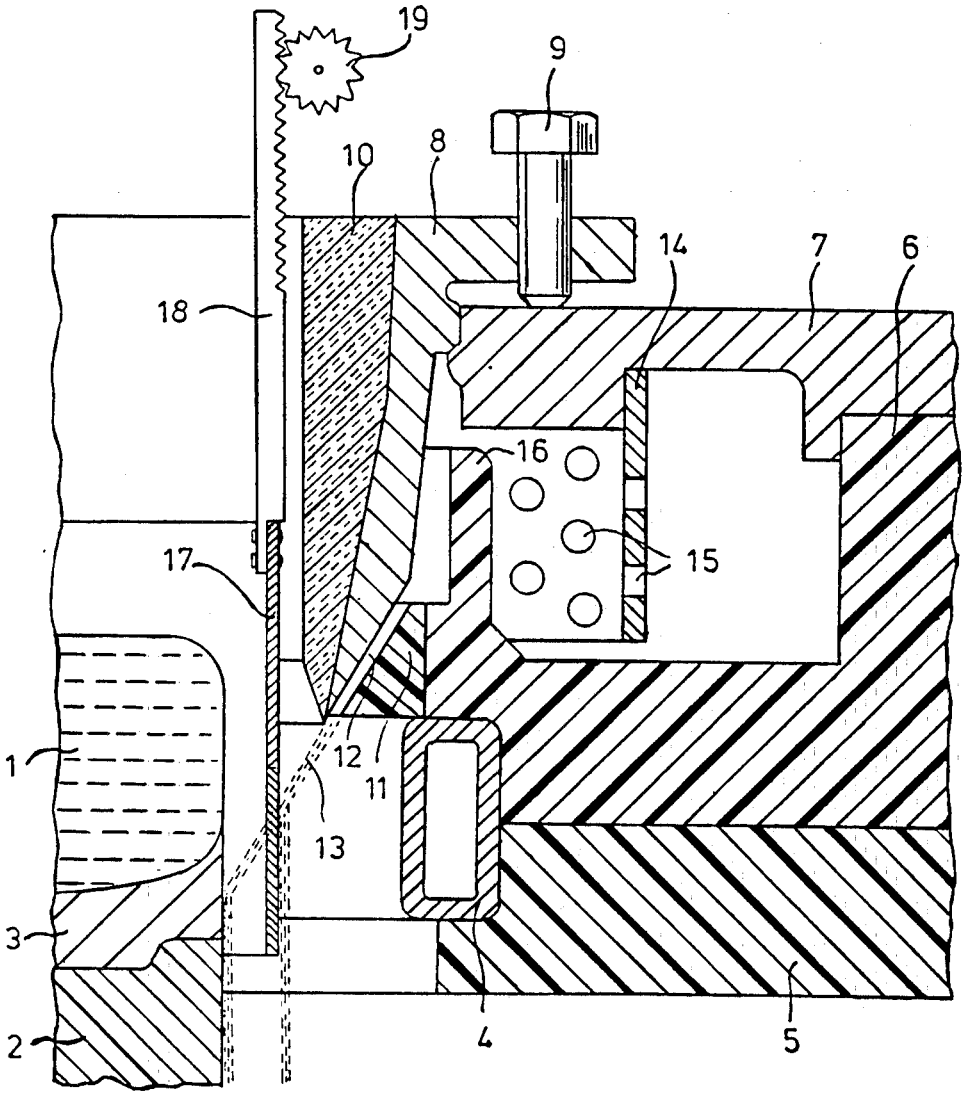
FIG. 1: A cross-section through a part of a DC mold with a deflection sheet.

An induction coil 4 in an mold for electromagnetic continuous casting is positioned around an opening for an ingot 1 with dummy base 2 supporting the ingot end 3; in the exemplified example shown here the coil 4 is in the form of a hollow section. This rests in a multi-component unit 5, 6 which is made of an insulating material featuring appropriate recesses for the induction coil 4. The upper part 6 of the unit is connected to a metallic top piece 7 and with that delimits spaces in which coolant can flow.

An electromagnetic screen 8 serves to adjust the magnetic field to the increasing metallostatic head in the ingot 1. This screen 8 is connected to the top piece 7 by means of a thread for screw fitting, and such that a chosen position for the screen 8 can be fixed by means of adjustable screws 9. In the exemplified embodiments shown in FIGS. 1 and 4 a cover 10 of refractory, insulating material is fitted in front of the screen 8.

On the inside of the upper supporting part 6 is an insulating body 11 which, together with the outer face of the electromagnetic screen 8, forms a ring-shaped slit 12, through which the coolant 13 is directed onto the ingot 1. The coolant is introduced into the space formed by the upper supporting part 6 and its top piece 7, then flows through various flow control elements, for example sieve plates 14 with holes 15, and a collar-like wier 16, before it emerges through the ring-shaped gap 12 at a predetermined angle which is given by the screen 8 in its function of adjusting the magnetic field to the metallostatic pressure in the ingot.

Projecting into the flow path of the coolant 13 emerging form the ring-shaped gap 12 is, as shown in FIG. 1, a deflection sheet 17 which lies parallel to the ingot axis. This sheet 17, for example a 0.5 mm thick stainless steel sheet, represents an intervening means of deflecting the coolant, the inner contour of which sheet 17 being made to match the cross sectional contour of the ingot 1. Cogged tracks rods 18 are attached to the deflection sheet 17 to allow it to be moved parallel to the main ingot axis during casting. To this end the rods 18 engage with cogged wheels 19 which are powered by a means not shown here.

Figure 2:
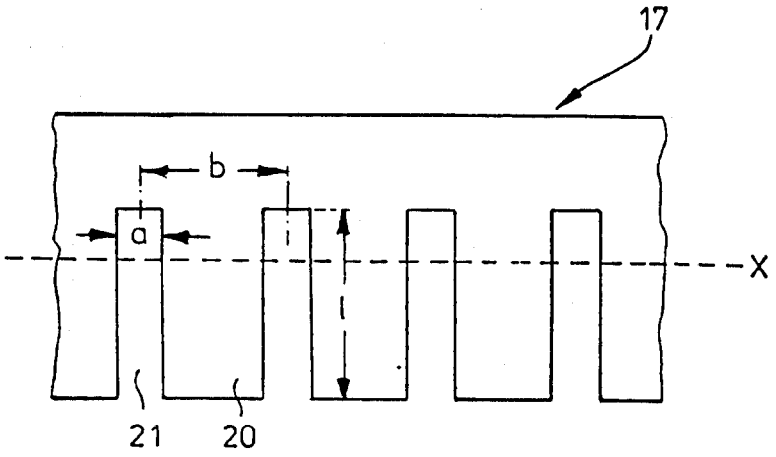
FIGS. 2 and 3: Two versions of the deflection sheet.

The deflection sheet 17 in FIG. 2 features at a spacing b of, for example 20 mm, slit-shaped openings 21 which are of length l, for example 25 mm, and breadth a, for example 5 mm, and are separated from each other by turret like tongues 20. X indicates a line where the coolant 13 emerging from the ring-shaped gap 12 intercepts the plane in which the deflection sheet 17 lies.

Figure 3:
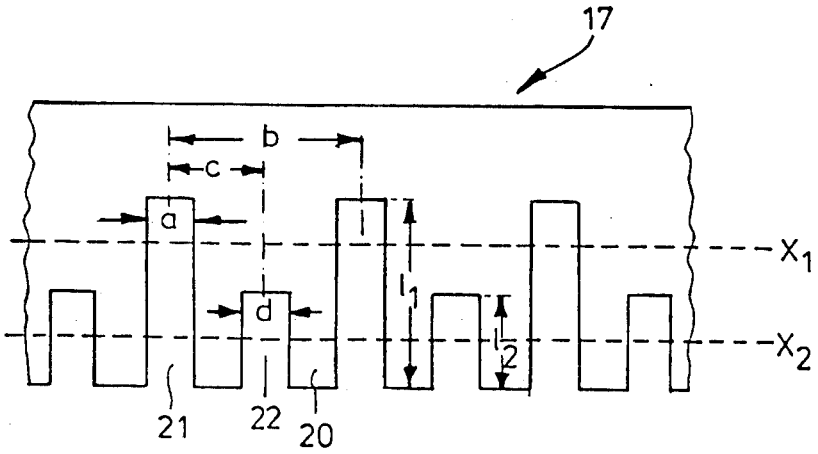

In another exemplified form of the deflection sheet 17, shown in FIG. 3, each tongue 20 is additionally provided with a smaller slit 22. The length l, of the slits 21 are, for example, 25 mm and the length $l_2$ of the smaller slit 22 are 15 mm. The slits 21 and the small slits 22 are of breadth a and d resp., for example 5 mm. The small slits 22 lie in the middle between two slits 21, i.e. the distance c between a slit and a neighboring small slit is 10 mm. $X_1$ and $X_2$ indicate two different lines where the coolant 13 from the ring-shaped gap 12 intercept the plane in which the deflections sheet 17 lies. Line $X_1$ intercepts only the slits; line $X_2$ also intercepts the small slits.

Figure 4:
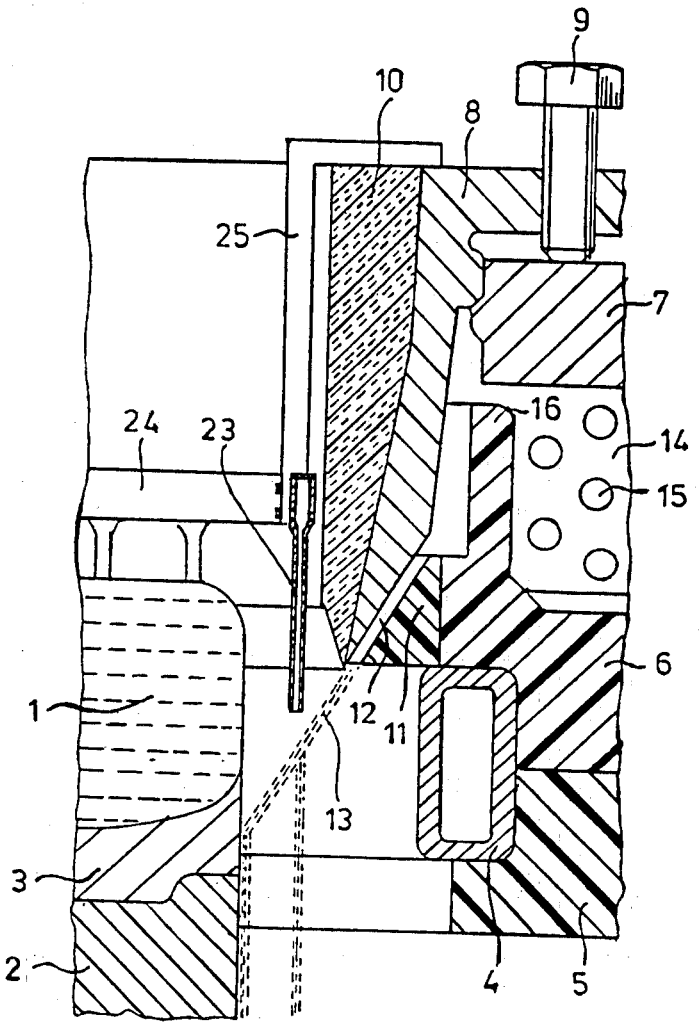
FIG. 4: A cross section through a part of a DC mold with deflecting nozzles.

In the exemplified embodiment shown in FIG. 4 tube like nozzles 23 are arranged parallel to the main ingot axis; the openings of these nozzles facing the path of the coolant 13 emerging from the ring-shaped gap 12 are at a distance of, for example, 5 mm from the coolant path as measured along the nozzle axis; the distance between individual nozzles is, for example, 20 mm. The nozzles 23 are connected up to a ring supply 24 which is in the form of a hollow section and which is connected to a compressed air reservoir, not shown in FIG. 4, via another supply pipe, which is also not shown here. The ring supply 24 is held in place by angled supports 25 which rest on the upper edge of the mold.

Figure 5:
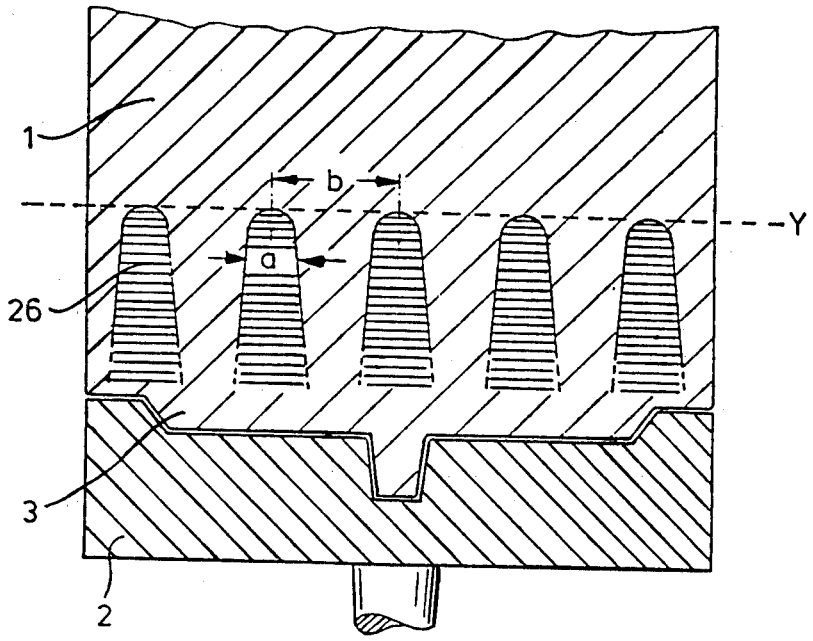
FIG. 5: Surface of a DC cast ingot cast using the process according to the invention.

The partial deflection of the coolant 13 from the gap 12 produces, as indicated in FIG. 5, an interruption of the line y of contact of the coolant with the surface of the ingot 1. The cooled areas 26 on the ingot surface due to the impinging and draining coolant are of a width a of, for example, 5 mm and at a spacing b, for example of 25 mm.

What is claimed is:

1. A process for electromagnetically continuously casting molten metal comprising:

providing a support frame;

providing an inductor associated with said support frame for applying a magnetic field to the molten metal to define a mold cavity;

providing a screen associated with said support frame for adjusting the magnetic field applied by said inductor;

providing coolant supply means including at least one discharge nozzle defined by a portion of said support frame and said screen for feeding a coolant stream to a first location of impingement on a surface of a cast ingot;

continuously casting metal into said mold cavity to produce a continuous casting;

providing deflecting means separate from said coolant supply means and remote and downstream of said at least one discharge nozzle defined by a portion of said support frame and said screen for controlling the position and angle of at least a portion of the coolant stream by deflecting and redirecting said at least a portion of said coolant stream emanating from said at least one discharge nozzle to a second location, taken along a direction of casting withdrawal, relatively below said first location of impingement of a stream emanating from said discharge nozzle; and deflecting and redirecting said at least a portion of said coolant stream from said first location such that the coolant is jetted as streams in zones which are separate from each other to said first location.

2. Process according to claim 1 wherein during the time that the coolant is jetted as streams to the separated zones, an ingot end at least 100 mm in length is produced.

3. Process according to claim 1 wherein the coolant is applied to separated zones during the entire continuous casting procedure.

4. Process according to claim 1 wherein each coolant stream has a neighboring coolant stream and wherein the coolant streams are jetted in such a width that the ratio of stream width to the distance to the neighboring coolant stream lies between 1:10 and 1:1.5 and the distance to the neighboring coolant stream is 5 to 50 mm.

5. Process according to claim 4 wherein the ratio of coolant stream width to the distance to the neighboring coolant stream is between 1:6 and 1:2.

6. Process according to claim 1 wherein said ingot has a main axis, the deflecting means is located substantially parallel to said main axis and said coolant is deflected by striking said deflecting means at an angle thereto.

7. Process according to claim 6 wherein said coolant strikes a plate having spaced openings therein.

8. Process according to claim 6 wherein said coolant strikes a plurality of spaced air jets.

9. Process according to claim 6 wherein the coolant flow path is at an acute angle to said main axis and the coolant is deflected by striking a deflecting means located at an acute angle to the coolant flow path.

10. A mold for electromagnetic continuous casting molten metal comprising a support frame, an inductor coil associated with said support frame for applying a magnetic field to define a mold cavity, a screen associated with said support frame for adjusting the magnetic field applied by said inductor and coolant supply means associated with said inductor including at least one discharge nozzle defined by a portion of said support frame and said screen for feeding a coolant stream from said coolant supply means to a first location of impingement on a surface of a cast ingot for solidifying said molten metal; the improvement comprising deflecting means separate from said coolant supply means and spaced apart from and downstream of said at least one discharge nozzle defined by a portion of said support frame and said screen for deflecting at least a portion of said coolant stream, said deflecting means comprises a sheet for deflecting and redirecting said at least a portion of said coolant stream emanating from said at least one discharge nozzle to a second location of impingement taken along a direction of casting withdrawal relatively below said first location of a stream emanating from said discharge nozzle such that the coolant is jetted as streams in zones which are separate from each other to said first location.

11. Mold according to claim 10 wherein the deflection means is provided with turret like tongues separated by openings.

12. Mold according to claim 11 wherein the ratio of width (a) of the openings to the distance (b) to the neighboring opening lies between 1:10 and 1:1.5, and the distance to the neighboring opening is 5 to 50 mm.

13. Mold according to claim 12 wherein the ratio of the width (a) of the openings to the distance to the neighboring opening lies between 1:6 and 1:2.

14. Mold according to claim 11 wherein the tongues include shorter openings parallel to the other openings, the length ($l_2$) of which shorter openings is smaller than the length ($l_1$) of the other openings.

15. Mold according to claim 10 wherein said ingot has a longitudinal axis and is operative to produce an ingot which is round in cross section, and wherein the deflection means is operative to be rotated about the longitudinal axis of the mold.

16. Continuous casting mold according to claim 10 wherein said continuously cast ingot is produced in an electromagnetic field, and wherein said deflection means comprise gas supply nozzles parallel to the main axis, the outlets of which are situated above the path of the stream of coolant emerging from the ring-shaped gap.

17. Mold according to claim 16 wherein neighboring nozzles are provided at a distance of 5 to 50 mm from each other.

18. Mold according to claim 17 wherein said neighboring nozzles are at a distance of 15 to 25 mm from each other.

19. Mold according to claim 16 wherein the nozzles are connected up to a gas supply ring.

20. Continuous casting mold for use in continuous direct chill casting in an electromagnetic field to produce a continuous cast ingot including cooling means for applying coolant in a flow path directly to the ingot surface as it emerges from the mold, and deflecting means projecting into the coolant flow path for deflecting said coolant as streams in zones which are separate from each other.

21. Continuous casting mold according to claim 10 wherein said deflecting means is located in said coolant flow path at an angle to said coolant flow path so that said coolant is deflected by striking said deflecting means at an angle thereto.

* * * * *